US010940517B2

(12) United States Patent
Zhang et al.

(10) Patent No.: US 10,940,517 B2
(45) Date of Patent: Mar. 9, 2021

(54) METHODS AND SYSTEMS TO FORM A PRODUCT IN A PRESS

(71) Applicant: Ford Global Technologies, LLC, Dearborn, MI (US)

(72) Inventors: Peter Zhang, Nanjing (CN); Vic Kong, Nanjing (CN); Jeffrey Dai, Nanjing (CN)

(73) Assignee: Ford Global Technologies, LLC, Dearborn, MI (US)

( * ) Notice: Subject to any disclaimer, the term of this patent is extended or adjusted under 35 U.S.C. 154(b) by 213 days.

(21) Appl. No.: 15/400,072

(22) Filed: Jan. 6, 2017

(65) Prior Publication Data

US 2017/0203352 A1 Jul. 20, 2017

(30) Foreign Application Priority Data

Jan. 20, 2016 (CN) ..... 201610037111.9

(51) Int. Cl.
*B21D 22/02* (2006.01)
*B21D 22/22* (2006.01)

(52) U.S. Cl.
CPC ..... *B21D 22/02* (2013.01); *B21D 22/22* (2013.01)

(58) Field of Classification Search
CPC ..... B21D 22/22; B21D 22/24; B21D 22/30; B21D 22/02; B29C 51/082; B29C 51/20; B29C 33/202; B29C 2043/3602
See application file for complete search history.

(56) References Cited

U.S. PATENT DOCUMENTS

| | | | | |
|---|---|---|---|---|
| 5,071,614 | A | 12/1991 | Grace | |
| 5,843,492 | A | 12/1998 | McCorry | |
| 6,953,545 | B1 | 10/2005 | Tyler | |
| 2009/0249856 | A1 * | 10/2009 | Smyers | B21D 22/22 72/453.07 |
| 2014/0302285 | A1 | 10/2014 | Ikeji et al. | |

FOREIGN PATENT DOCUMENTS

| | | | | |
|---|---|---|---|---|
| CN | 85106107 | A | 3/1987 | |
| CN | 86107980 | A | 7/1987 | |
| CN | 201350483 | Y | 11/2009 | |
| CN | 20219366 | U | 2/2012 | |
| DE | 233036 | * | 2/1986 | B21D 22/22 |
| DE | 233036 | A3 | 2/1986 | |
| DE | 102008032911 | A1 | 11/2009 | |
| EP | 1306477 | A1 | 5/2003 | |

OTHER PUBLICATIONS

Jul. 29, 2019, Office Action of the China National Intellectual Property Administration, issued in patent application No. CN 201610037111.9, which is a related application of Applicant Ford Global Technologies, LLC.

* cited by examiner

*Primary Examiner* — Jacob T Minskey
*Assistant Examiner* — S. Behrooz Ghorishi
(74) *Attorney, Agent, or Firm* — Alice Xu; Kolitch Romano LLP

(57) ABSTRACT

A method to form a product from a work-piece in a press is provided. The press includes a top tooling and a bottom tooling and a clamping device. The method comprises pressing the work-piece at a first stage of a top tooling movement in the bottom tooling; and clamping and pressing the work-piece at a second stage of the top tooling movement in the bottom tooling.

14 Claims, 5 Drawing Sheets

METHODS AND SYSTEMS TO FORM A PRODUCT IN A PRESS

RELATED APPLICATION

This application claims the benefit of Chinese Patent Application No.: CN 201610037111.9 filed on Jan. 20, 2016, the entire contents thereof being incorporated herein by reference.

FIELD

The present disclosure relates to methods and systems to form a product in a press, in particular relates to methods and systems to form a product with reduced stretch rate.

BACKGROUND OF INVENTION

A press is commonly used to form a product by application of pressure. In some conventional technologies, a punch is employed directly to press on a work-piece to form a product. In these technologies, the product can have wrinkles or missing edge portions when the work-piece is not clamped during the pressing process. In some conventional technologies, an entire edge portions of the work-piece are clamped by a clamping device and then the work-piece is pressed. Such technologies, however, may result in a high stretching rate of the work-piece and cause some issues. For example, when a stretching rate exceeds 20%, deformation due to the stretch of the work piece can affect the product's appearance, and touch and feel and can reduce the strength of the product.

SUMMARY OF THE INVENTION

According to one aspect of the present disclosure, a method to form a product from a work-piece in a press is provided. The press includes a top tooling and a bottom tooling and a clamping device. The method comprises pressing the work-piece at a first stage of a top tooling movement in the bottom tooling; and clamping and pressing the work-piece at a second stage of the top tooling movement in the bottom tooling.

In one embodiment, pressing the work-piece at the first stage is performed without clamping the work-piece.

In one embodiment, pressing the work-piece at the first stage includes clamping at least one of a plurality of edge portions of the work-piece.

In another embodiment, the clamping device includes a plurality of clamping units, and each of the clamping units are individually controlled to clamp or unclamp a corresponding edge portion of the work-piece.

In another embodiment, a time to initiate clamping for at least one clamping unit is different from that for other clamping devices.

In another embodiment, a clamping force from at least one clamping unit is different from that from other clamping units during a pressing process.

In another embodiment, a dynamic clamping force is applied to the work-piece during the second stage.

In another embodiment, the clamping device includes a plurality of clamping units, the method further comprising pressing the work-piece at a third stage of the top tooling movement, wherein the clamping units are selectively activated to clamp edge portions of the work-piece.

In another embodiment, the clamping device includes a plurality of individually controlled clamping units, and wherein the plurality of clamping units are positioned around edge portions of the work-piece.

In another embodiment, the product includes a first section and a second section recessed from a main surface of the first section, and wherein pressing the work-piece at a first stage of the top tooling movement in the bottom tooling includes clamping the work-piece using at least one clamping unit spaced further away from the second section.

In another embodiment, clamping and pressing the work-piece at a second stage of the top tooling movement in the bottom tooling includes clamping the work-piece using at least one clamping unit adjacent to the second section while maintain the clamping unit spaced away from the second section active.

In another embodiment, the top tooling move approximately 80% of a total moving distance at the first stage, and moves approximately 20% of the total moving distance at the second stage.

In another embodiment, the work-piece is made from one of the polymer, fabric and woven materials and the product is a headliner in a vehicle.

According to another aspect, a method to form a product from a work-piece using a press is provided. The press includes a top tooling, a bottom tooling and a clamping device. The method comprises moving the top tooling to press the work-piece; and activating the clamping device based on a distance of the top tooling moved in a pressing process.

In one embodiment, the clamping device is activated after the top tooling moves a first predetermined distance in the bottom tooling.

In another embodiment, the clamping device includes a first group of clamping units and a second group of clamping units. The first group of the clamping unit is activated during the top tooling movement within a first predetermined distance, and both the first and second groups of the clamping units are activated during the top tooling movement within a second predetermined distance following the first moving distance.

According to another aspect, a press system to form a product from a work-piece is provided. The press comprises a bottom tooling with a cavity; a top tooling to press the work-piece in the cavity; a clamping device configured to clamp edge portions of the work-piece; and a controller configured to control the top tooling to press the work-piece at a first stage and a second stage, and activate the clamping device to clamp the work-piece at the second stage.

In one embodiment, the clamping device includes a plurality of individually controlled clamping units.

In another embodiment, the controller is configured to activate at least one clamping units at a time different from activating other clamping units.

In another embodiment, the controller is configured to enable a clamping force from at least one clamping unit at a time different from that of other clamping units.

The methods and systems of the present disclosure can at least solve some issues of the conventional technologies. For example, the stretch rate of the work-piece can he significantly reduced because of no clamping at the first stage of the pressing process. As such, the issues associated with the high stretch rate can be solved. For example, the material utilization can be improved and the size of the work-piece used in the pressing process can be optimized. Further, a better appearance, and fine touch and feel of the product can be achieved.

BRIEF DESCRIPTION OF THE DRAWINGS

FIG. 5A is a plan view and FIG. 5B is a cross section view.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION

Figure 1:
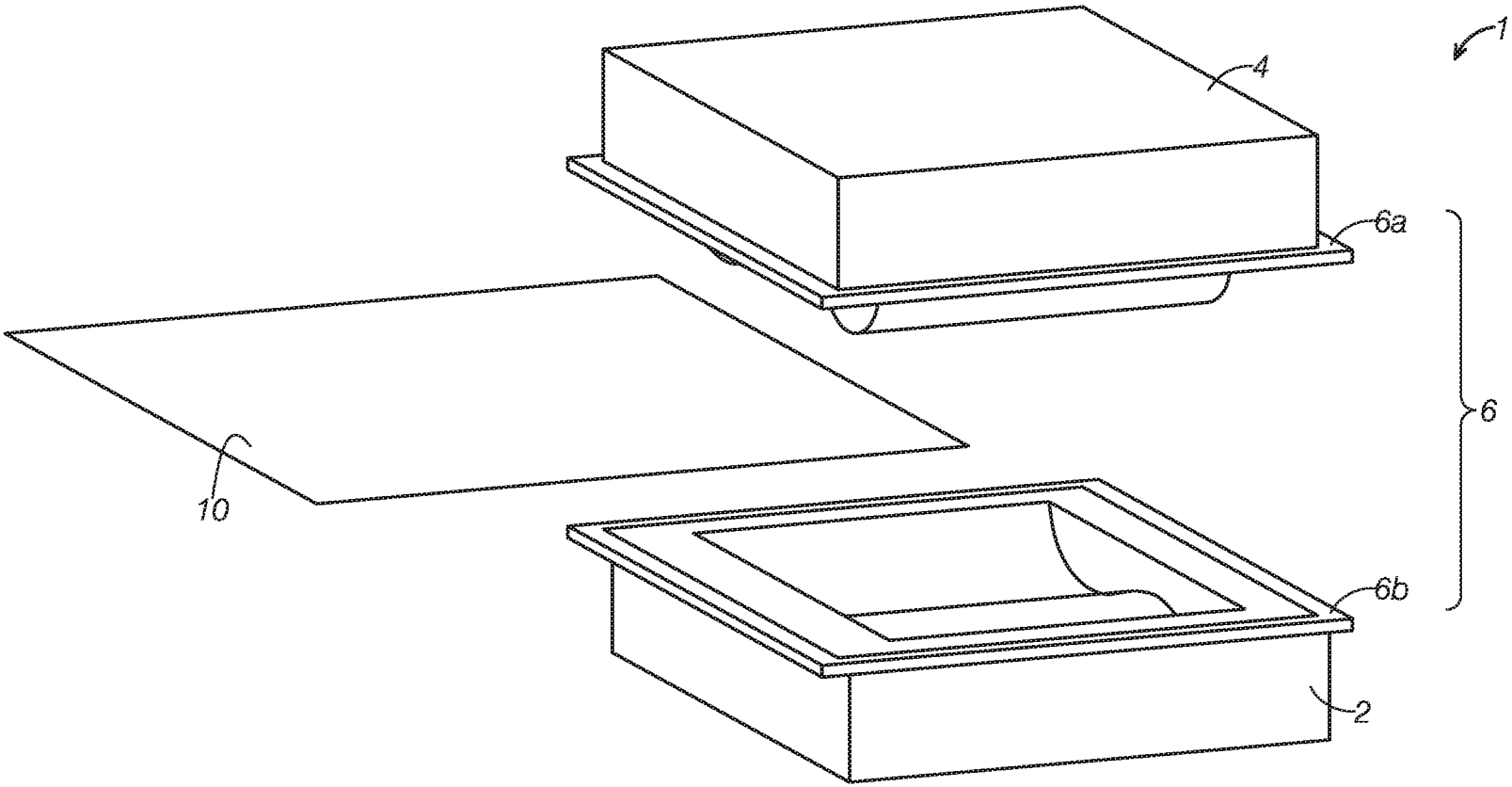
FIG. 1 depicts an example press in which illustrative embodiments of the present disclosure may be implemented.

FIG. 1 depicts an example press 1 in which illustrative embodiments of the present disclosure may be implemented and a work piece 10. The press 1 may be any suitable machine tool that changes the shape of a work piece by the application of pressure. The press 1 may operate under hydraulic, mechanical or pneumatic power. The press 1 may include a bottom tooling 2, a top tooling 4 and a clamping device 6. The bottom tooling 2 may include a cavity to conform the shape of the top tooling 4. The top tooling 4 or a punch applies pressure to the work-piece as it moves in the cavity of the bottom tooling 2 A product is formed after pressing process is completed. The clamping device 6 may include two parts 6*a* and 6*b* disposed on the top tooling 4 and the bottom tooling 2, respectively and may apply clamping force at different stages of pressing process.

Figure 2A:
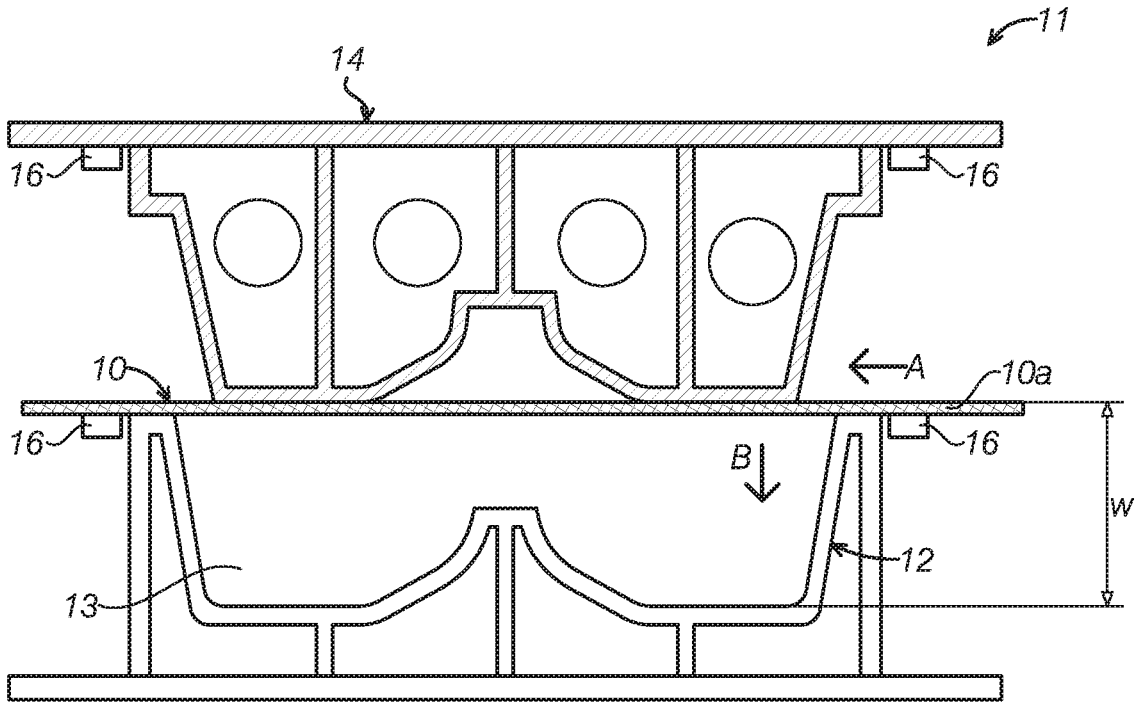
FIGS. 2A and 2B depict another example press in which illustrative embodiments of the present disclosure may be implemented.
Figure 2B:
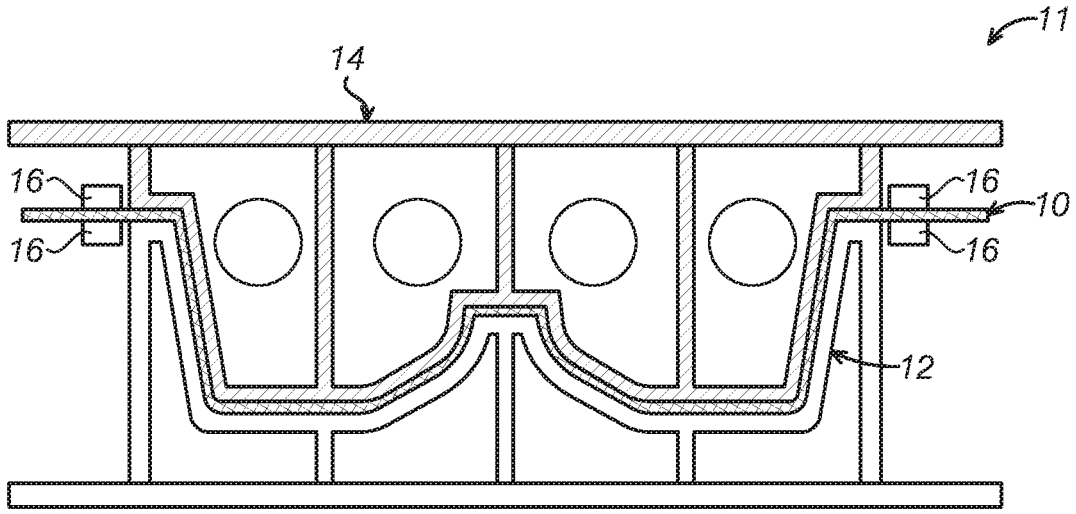

FIG. 2A and 2B depict another example press 11 in which illustrative embodiments of the present disclosure may be implemented. The press 11 may include a bottom tooling 12 having a cavity 13, a top tooling 14, and a clamping device 16. FIG. 2A shows that a work-piece 10 is placed on a top of the bottom tooling 12 at a starting position to initiate the pressing process or a movement of the work-piece 10 into the cavity 13 with the top tooling 14. At the starting position, the top tooling 14 at least partially contacts the work-piece but has not pressed the work-piece. FIG. 2A shows that a maximum depth of the cavity 13 is W, which is a total moving distance that the top tooling 14 can travel in the cavity 13. FIG. 2B shows that the work-piece 10 is located at bottom of the cavity 13, that is, the work-piece 10 is at a finishing position that the pressing process is completed.

Figure 3:
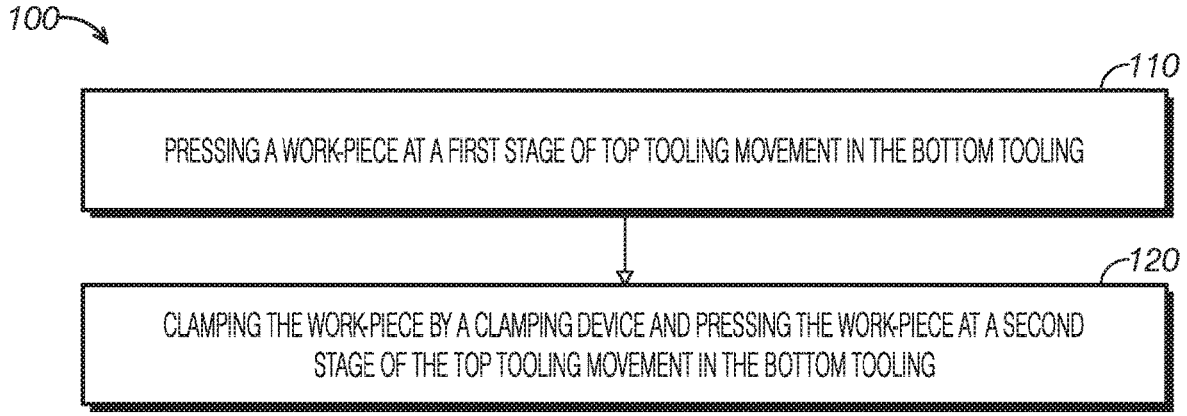
FIG. 3 is a high level flowchart of a method to press a work piece to form a product according to one example embodiment of the present disclosure.

FIG. 3 is a high level flowchart of a method 100 to press a work piece to form a product according to one example embodiment the present disclosure. At 110, the method 100 includes pressing a work-piece at a first stage of a top tooling movement. In some embodiment, pressing the work-piece at the first stage may include moving the work-piece with the top tooling in the bottom tooling or a cavity in the bottom tooling. Referring to FIGS. 2A and 2B, the first stage of the top tooling movement may refer to the pressing stage in which the work-piece is moved with the top tooling 14 from the starting position shown in FIG. 2A to a middle position in the cavity 13 of the bottom tooling 12. The middle position may be any position between the starting position shown in FIG. 2A and the finishing position shown in FIG. 2B as describe in detail below. In some embodiments, the first stage may correspond to a first moving distance between the starting position and the middle position.

At 120, method 100 includes clamping the work-piece by a clamping device and pressing the work-piece at a second stage of the top tooling movement in the bottom tooling. In some embodiments, the second stage may refer to the pressing stage in which the work-piece is moved with the top tooling 14 from the middle position to the finishing position as shown in FIG. 2B or moved a second moving distance from the middle position to the finishing position. In some embodiments, the second stage may refer to the pressing stage in which the work-piece is moved with the top tooling 14 from the middle position to a next position closer to the bottom of the cavity 13 or moved a second moving distance from the middle position to the position further downward. A total moving distance or a target depth may be defined as a distance W that the top tooling can move from the starting position to the finishing position as shown in FIG. 2A. The total distance W may be the largest depth of the cavity 13. The first and second moving distances are parts of the total moving distance.

In some embodiments, at the first stage, the work-piece is not clamped at any position of its edge portions with a clamping device as described below. In some embodiments, only parts of the edge portions of the work piece are clamped at the first stage, as described below.

In some embodiments, the first moving distance may be 80% of a target pressing depth that the work-piece can be moved until the formation of the product or the total moving distance W. For example, if a recess of 100 mm is needed to he formed on the work-piece, the first moving distance of the top tooling 14 is a distance that makes the work-piece to be recessed 80 mm. It should be appreciated that the moving distance in each stage depends on requirement of the formed product and type of work material.

At the first stage, a stretch rate of the work-piece basically does not change because the work-piece is not clamped. In some embodiments, because of unclamping or only clamping on a portion of the work-piece, at least part of the work-piece outside the cavity can freely move down to the cavity of the bottom tooling. For example, referring to FIG. 2A, the work-piece 10*a* outside of tooling cavity 13 can be laterally moved into the cavity 13 from outside of the cavity 13 as shown by an arrow A and then moved vertically with the top tooling 14 (as shown by an arrow B) to be pre-pressed. At the second stage, the work-piece 10 moves with the top tooling 14 and is clamped and further pressed in the cavity 13. Since the work-piece is pressed without being clamped at the first stage, stretching rate of the work-piece is significantly reduced in comparison of one stage process, and thus prevent some issued due to over stretching of the work-piece. In this way, the material's utilization can be increased and the dimension of the work-piece used for forming the product can be optimized. Further, the product has better appearance, and touch and feel.

Figure 4:
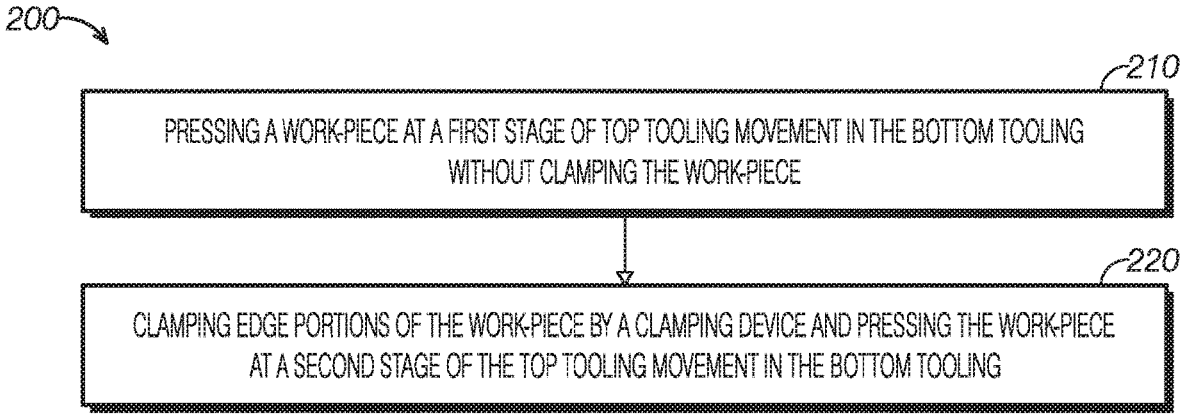
FIG. 4 is a flowchart of a method to press a work-piece to form a product according to another example embodiment the present disclosure.

FIG. 4 is a flowchart of a method 200 to press a work-piece to form a product according to one example embodiment the present invention. At 210, the method 200 includes pressing a work-piece at a first stage of top tooling movement in the bottom tooling without clamping the work-piece. With reference to FIGS. 2A and 2B, the clamping device 16 is configured to clamp on edge portions of the work-piece 10. However, the work piece is not clamped at the first stage. At 220, the method includes clamping the edge portions of the work-piece by a clamping device and pressing the work-piece at a second stage of the top tooling movement in the bottom tooling. With reference to FIGS. 2A and 2B, at the second stage, at least a portion of the work-piece 10 moves into the cavity 13 with the top tooling 14. In some embodiments an entire edge portions of the work-piece 10 is clamped with a clamping device 16 while the work-piece is further pressed. The work-piece is stretched again until a product is formed. The product means a finished product, and the unnecessary portion of the work-piece is offcut material.

Since the work-piece is pressed without being clamped at he first stage, stretching rate of the work-piece is significantly reduced in comparison of one stage process, and thus prevent some issued resulted from the over stretching of the work-piece. In this way, the material's utilization can be increased and the dimension of the work-piece used for forming the product can be optimized to achieve better appearance, and touch and feel.

Figure 5A:
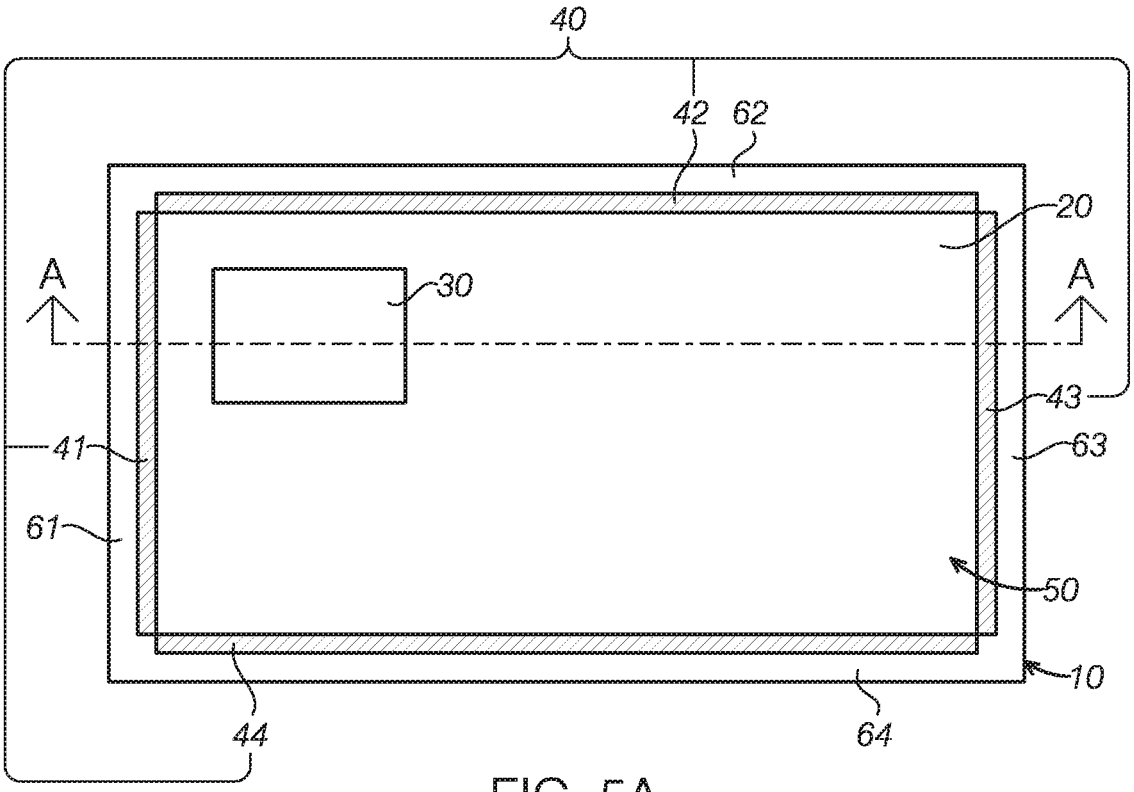
FIGS. 5A and 5B are a schematic diagram showing a product and a clamping device disposed on a work-piece.
Figure 5B:
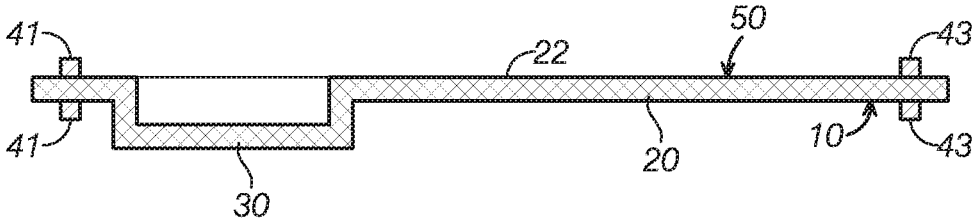

FIGS. 5A and 5B are a schematic diagrams showing a product 50 and a clamping device 40 disposed on a work-piece 10. As shown in FIGS. 5A and 5B, the product 50 includes a first section 20 and a second section 30 recessed from a main surface 22 of the first section 20. That is, a work-piece 10 needs to be pressed to form the first section 20 and a second section 30. The first section 20 may be referred to as normal press area, and the second section 30 may be referred to as a deeper press area. FIGS. 5A and 5B also shows a clamping device 40 disposed on edge portions 61, 62, 63, 64 of the work-piece 10. The clamping device 40 may include a plurality of clamping units, 41, 42, 43 and 44, which may be individually controlled.

Figure 6:
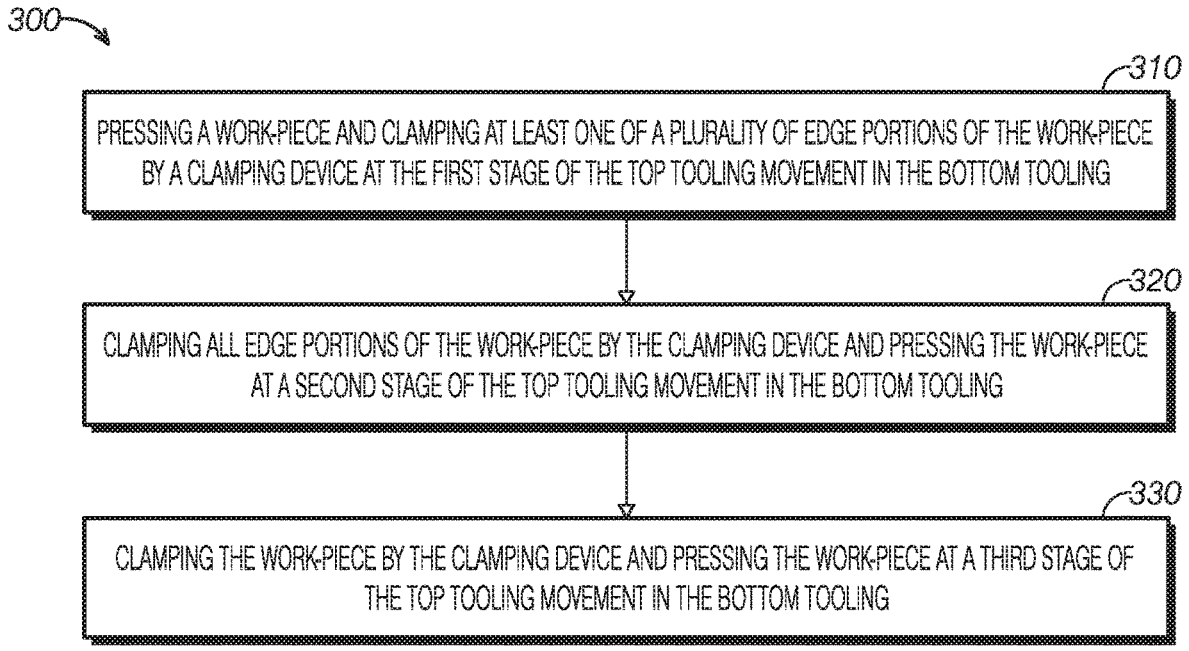
FIG. 6 is a flowchart of a method to press a work-piece to form a product according to another example embodiment of the present disclosure.

FIG. 6 is a flowchart of a method 300 to form the product 50 shown in FIGS. 5A and 5B according to another example embodiment of the present disclosure. At 310, method 300 includes pressing a work-piece and clamping at least one of a plurality of edge portions of the work-piece by a clamping device at the first stage of the top tooling movement in the bottom tooling. At the first stage, selected edge portions of the work-piece 10 away from the second section 30 are clamped using the clamping device 40, and the work-piece 10 is pressed to a predetermined depth. For example, the workpiece 10 may be pressed to 80% of a targeted depth at the first stage.

At 320, the method 300 may include clamping selected edge portions of the work-piece by the clamping device and pressing the work-piece at a second stage of the top tooling movement in the bottom tooling. In some embodiments, clamping selected edge portions of the work-piece at a second stage may include clamping all edge portions of the work piece by the clamping device.

At the second stage when at least a portion of the work-piece 10 moves into tooling cavity 12 with the top tooling 14, and all edge portions of the work-piece 10 are clamped with clamping device 40, and the work-piece 10 is moved with the top tooling 14 to be further pressed. The work-piece 10 is further stretched until formation of the first section 20 and the second section 30 at the second stage. All edge portions refer to the edge portions that can be clamped by the clamping device 40.

It should be understood that the top tooling 14 may move any suitable percentage of the target depth depending on the product formed and type of material, for example. In one embodiment, the depth moved in the first stage or the first moving distance may be the depth where a stretching rate of less than 20% can be achieved. In another embodiment, a final stretch rate can be greater than 20% depending on the stretch rate of the work-piece, the requirement on the appearance, and quality.

In some embodiments, the work-piece 10 may be clamped at different edge portions via a plurality of individual controlled clamping devices. As shown in FIGS. 5A and 5B, the clamping devices 40 may include a plurality of clamping units 41, 42, 43, and 44 to clamp the corresponding edge portions 61, 62, 63 and 64 of the work-piece 10, respectively.

In some embodiments, at least one clamping unit is activated to perform the clamping at a time different from others. In the depicted embodiment, at the first stage, an edge portions 63, 64 of the workpiece 10 that are located further away from the deeper press area (i.e., the second section 30) is clamped by a first group of the clamping units 43 and 44 at the first stage. Because the pressed depth of the portion of the first section 20 further away from the second section 30 is relative small, clamping has a small effect on stretch rate for this portion. After the first stage, all edge portions (i.e., 61, 62, 63, 64) of the work-piece 10 are clamped with the first group of clamping units 43, and 44 and a second group of clamping units, 41, 42 (i.e., all clamping units), then the top tooling 14 further press the work-piece 10 in the bottom tooling 12 at the second stage.

In some embodiment, a clamping force of at least one clamping unit is different from that of other clamping units during a pressing process. As shown in FIGS. 5A and 5B, the product includes the first section 20 and the second section 30, and the second section 30 is a recessed portion located in the first f section 20. In other words, the product includes a plural of sections with different target depths. Based on different depths at different position on the work-piece 10, each clamping unit can have different clamping forces to control stretch rate on the work-piece. For example, a less clamping force is applied on an area adjacent to the section having a greater target depth, and a greater clamping force is applied at an area adjacent to the section have a less target depth.

In some embodiments, at the second stage, a clamping force is dynamically applied to press the work-piece. For example, as shown in FIGS. 5A and 5B, at second press stage, clamping force at the clamping units 41 and 42 can be increased gradually. In another embodiment, one or more clamping forces at the clamping units 41, 42, 43, and 44 can be gradually increased to a maximum value and keep constant until completion of the pressing process.

In some embodiments, the clamping device 40 may operate independently from the top tooling 14 and may be dynamically controlled. In other words, the operation of the top tooling 14 and clamping device 40 are independent. With dynamically controlled clamping force, clamping force can be adjusted dynamically to achieve better quality and appearance of the product based on requirements on the appearance and quality of the product, and other factors.

In some embodiments, clamping units 41, 42, 43, and 44 may he individually and dynamically controlled, i.e., each clamping unit may have its own controller or control unit so that clamping, unclamping, and the magnitude of the clamping force may be controlled separately. Therefore, the clamping device used in this invention is more flexible and beneficial to control the stretch rate of the work-piece.

In some embodiment, after the second stage, a third stage may be performed. At 330, method 300 may include clamping the work-piece by the clamping device and pressing the work-piece at a third stage of the top tooling movement in the bottom tooling. At the third stage, the edge portions of the work-piece may be selectively clamped. For example, the top tooling 14 moves at first stage in the cavity 13 of the bottom tooling 12, next the top tooling 14 moves down at second stage to further press the workpiece 10 in the cavity 13 to further stretch the work piece 10 to form the first section 20. Next, the work-piece 10 is clamped and pressed at the third stage to form the second section 30. it should be understood that the top tooling 14 may move in a plurality of stages based on various factors such as material of the work-piece or the requirement for the product.

In some embodiment, a method of pressing a work-piece may include moving the top tooling to press the work-piece in a bottom tooling; and activating a clamping device based on a distance of the top tooling moved during a pressing process. In one embodiment, the clamping device is activated after the top tooling moves a first predetermined distance in the bottom tooling. In another embodiment, the clamping device includes a first group of clamping units (e.g., clamping units 43, 44) and a second group of clamping units (e.g., clamping units 41, 42). The first group of the clamping unit is activated during the top tooling movement within a first predetermined distance, and both the first and second groups of the clamping units are activated during the top tooling movement within a second predetermined distance following the first moving distance. The distance of the top tooling moved during the pressing process may be determined by a controller that controls the top tooling or determined by a sensor installed on the press to measure the movement of the top tooling.

Figure 7:
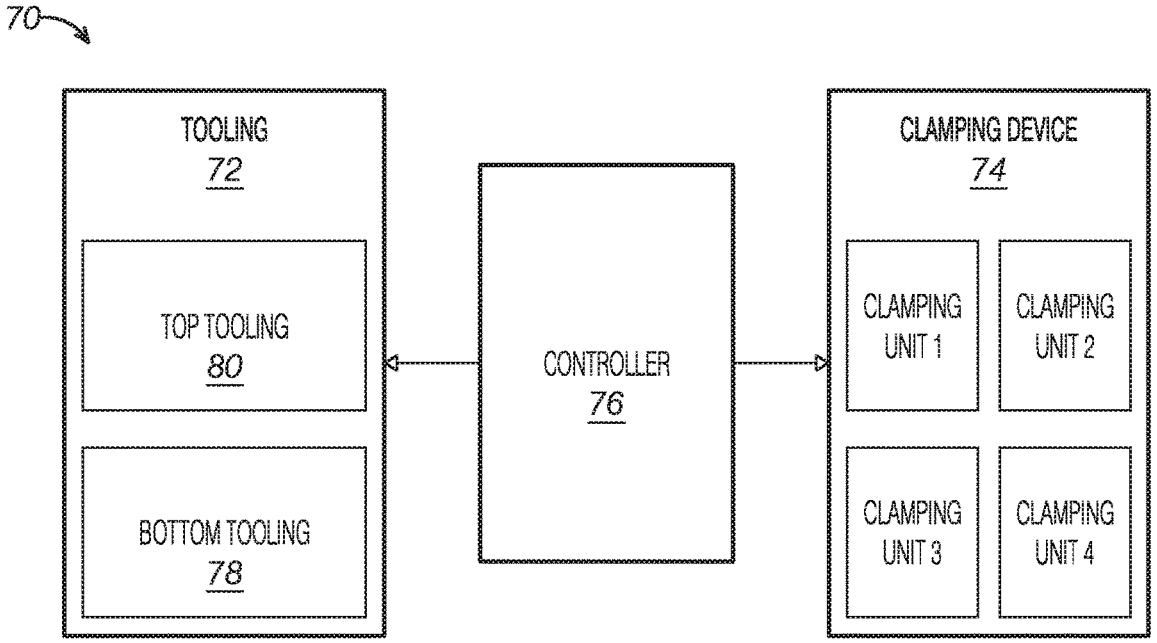
FIG. 7 is a block diagram of a press system according to one example embodiment of the present disclosure.

FIG. 7 is a block diagram of a press system 70 according to one example embodiment of the present disclosure. The press system 70 may include a tooling 72, a clamping device 74 and a controller 76. The tooling may include a bottom tooling 78 having a cavity and a top tooling 80 moveable relative to the bottom tooling 78, which together define a shape of a product to be formed from the press. The clamping device 74 may include two parts attached to the bottom tooling 78 and top tooling 80, respectively. The controller 76 communicated with the tooling 72 to control the movement of the top tooling 80 and determine a depth of the top tooling 80 in the cavity of the bottom tooling 78. The controller 76 is further communicated with the clamping device 74 to control a time to activate the clamping device 74 and apply a clamping force. In some embodiments, the controller 76 may be configured to activate the clamping device based on the depth of top tooling 80 in the cavity of the bottom tooling 78.

In some embodiment, the controller 76 may be configured to activate the top tooling 80 at a first time to move the top tooling 80 at a fist stage and activate a clamping device 74 at a second time and move the top tooling 80 while maintaining clamping force at a second stage. At the first stage, any edge portions of the work-piece are not clamped When at least a portion of the work-piece moves in the cavity with the top tooling 80, all edge portions of the work-piece are clamped, while the top tooling 80 moves at the second stage to further press the workpiece 10 to form product.

At the first stage of the movement of the top tooling 80, the controller of the press only activates the top tooling 80 but does not activate the clamping device. Because work-piece is not clamped in the first stage, stretch rate is generally not changed. At the second stage, the top tooling 80 moves and the controller 76 is configured to activate the clamping device 74 to clamp the work-piece and further press the work-piece as the top tooling 80 moves in the cavity of the bottom tooling 78. Since the work-piece is pressed in the first stage without being clamped, the stretch rate is significantly reduced comparing to one stage process, and thus prevent some issues resulted from the high stretching rate. In this way material's utilization and optimization on the use of workpiece can be improved and better appearance and touch and feel can be achieved.

In some embodiments, the clamping device 74 comprises a plurality of clamping units 1, 2, 3 and 4 controlled individually by the controller 76.

In some embodiments, the controller 80 is configured to activate one clamping unit at a time different from other clamping units.

In some embodiments, the controller 80 is configured to control the clamping unit to apply a clamping force in one clamping unit different from other clamping units. In some embodiments, the controller 80 is configured to enable the clamping device 74 to apply dynamically clamping force on the work-piece when the top tooling 80 moves further in the second press stage.

The controller 80 may be configured for different applications. In one example, the controller 80 is configured to control the clamping device 74 and the top tooling 80 independently and dynamically so that the clamping operations of the clamping device 74 and pressing operation of the top tooling 80 can be performed independently to have high flexibility.

Furthermore, the controller 80 may be configured to control the clamping device 74 independently and dynamically, i.e., each clamping unit can individually perform the operations of clamping, unclamping, or applying different clamping forces. Therefore, the clamping device 74 is flexible and advantageous in controlling the stretch rate in the pressing process.

According to another embodiment of the present disclosure, a method is provided to form a vehicle headliner. With reference to FIGS. 2A and 2B, at least a portion of the work-piece is moved with the top tooling 14 in the cavity 13 of the bottom tooling 12 at the first stage, and the work-piece is clamped and further pressed by the top tooling 14 at the second stage.

The method for forming a vehicle headliner moves at least a portion of work-piece moves in the tooling cavity 12 with the top tooling 14. Because the work-piece is not clamped in the first stage, the stretch rate is generally unchanged. At the second stage of the top tooling 14 movement, the workpiece is clamped and further pressed in the cavity 13 of the bottom tooling 12. Because the work-piece is pressed without being clamped in the first stage, stretch rate is generally not changed comparing to one-stage pressing process, and thus avoid some problems from over stretching. As such, material utilization and optimization on the use of work-piece can be improved, and better appearance, and good touch and feel can be realized.

In another embodiment, a step of moving at least a portion of the work-piece moves in to the tooling cavity with the top tooling 14 at the first stage is performed with the work-piece not being clamped.

In another embodiment, a step of moving the top tooling 14 and clamping the work-piece at the second stage is performed by activating the clamping device to clamp the work-piece and further pressing the work-piece while the clamping is maintained.

In another embodiment, the clamping device comprises a plurality of individually controlled clamping units. The clamping device are positioned at a normal pressing area and around edge portions of the work-piece.

In another embodiment, when the top tooling 14 moves at first stage, at least one clamping unit disposed further away from the deeper press area is activated to clamp the work-piece.

In another embodiment, the step of clamping the work-piece when the top tooling 14 moves at the second stage to further press workpiece in the tooling cavity 12 includes clamping the workpiece by at least one clamping unit adjacent to the deeper press while keeping the operation at least one previously activated clamping unit.

In another embodiment, at the first stage, the top tooling moves a first moving distance, which is 80% of the total moving distance of the top tooling 14. At the second stage, the top tooling moves a second moving distance, which is 20% of the total moving distance of the top tooling 14. It should be understood that the work-piece can be moved to other percentage of a total moving distance or a percentage of a target depth at the first and second stages depending on factors such as the requirement for the formed product and the material of the work-piece, as long as the stretch rate of the product is less than 20% or about 20%. In other embodiments, stretch rate may be greater than 20% depending on stretch rate of the work-piece, the requirements on the appearance, quality, and other factors.

In some embodiments, the material of workpiece may include one of the polymer, fabric and woven materials. The method of the present disclosure can be used to form the interior trims of the vehicle such as an inner trim, carpets. It should be understood that the method of the present disclosure can be used to press any rigid parts in the vehicle such as body panels, headliners layers, engine parts as well as rigid parts in the vehicle frames.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into computer readable storage medium in the engine control system.

It will be appreciated that the configurations and routines disclosed herein are exemplary in nature, and that these specific embodiments are not to be considered in a limiting sense, because numerous variations are possible.

The following claims particularly point out certain combinations and subcombinations regarded as novel and non-obvious. These claims may refer to "an" element or "a first" element or the equivalent thereof. Such claims should be understood to include incorporation of one or more such elements, neither requiring nor excluding two or more such elements. Other combinations subcombinations of the disclosed features, functions, elements, and/or properties may be claimed through amendment of the present claims or through presentation of new claims in this or a related application.

The invention claimed is:

1. A method to form a product from a work-piece in a press, the press including a top tooling and a bottom tooling and a clamping device, the method comprising:

pressing the work-piece at a first stage of a top tooling movement into the bottom tooling; and then, clamping the work-piece by the clamping device and pressing the work-piece at a second stage of the same top tooling movement into the bottom tooling;

wherein the work-piece has a starting position, an intermediate position and a finishing position;

wherein the first stage starts at the starting position at which the top tooling at least partially contacts the work-piece, and the second stage starts at the intermediate position after the top tooling has moved at least partially into the bottom tooling;

wherein a clamping force applied at the second stage is greater than a clamping force applied at the first stage and is maintained at the second stage and a stretch rate of the work-piece due to the clamping force is lower at the first stage than that in the second stage;

wherein the clamping device includes a first part disposed on the top tooling and a second part disposed on bottom tooling and the second part is stationary during the top tooling movement; and wherein the work-piece is made from one of polymer, fabric and woven materials.

2. The method of claim 1, wherein pressing the work-piece at the first stage is performed without clamping the work-piece.

3. The method of claim 1, wherein pressing the work-piece at the first stage includes clamping at least one of a plurality of edge portions of the work-piece.

4. The method of claim 1, wherein the clamping device includes a plurality of clamping units, and each of the plurality of clamping units is individually controlled to clamp or unclamp a corresponding edge portion of the work-piece.

5. The method of claim 4, wherein a time to initiate clamping for at least one clamping unit is different from that for other clamping units.

6. The method of claim 4, wherein a clamping force from at least one clamping unit is different from that of other clamping units during a pressing process.

7. The method of claim 1, wherein a dynamic clamping force is applied to the work-piece during the second stage.

8. The method of claim 1, wherein the clamping device includes a plurality of clamping units, the method further comprising pressing the work-piece at a third stage of the top tooling movement, wherein the plurality of clamping units are selectively activated to clamp edge portions of the work-piece.

9. The method of claim 1, wherein the clamping device includes a plurality of individually controlled clamping units, and wherein the plurality of clamping units are positioned around edge portions of the work-piece.

10. The method of claim 9, wherein the product includes a first section and a second section recessed from a main surface of the first section and having a deeper press area, wherein the plurality of clamping units include a first group of clamping units spaced away from the second section and a second group of clamping units adiacent to the second section, and wherein pressing the work-piece at the first stage of the top tooling movement into the bottom tooling includes clamping the work-piece using the first group of clamping units spaced away from the second section;

wherein clamping and pressing the work-piece at the second stage of the top tooling movement into the bottom tooling includes clamping the work-piece using the second group of clamping units adiacent to the second section while maintaining the first group of the clamping units spaced away from the second section active.

11. The method of claim 1, wherein the top tooling moves approximately 80% of a total moving distance at the first stage, and moves approximately 20% of the total moving distance at the second stage.

12. The method of claim 1, wherein the product is a headliner in a vehicle.

13. A method to form a product from a work-piece using a press, the press including a top tooling, a bottom tooling and a clamping device, comprising:

pressing the work-piece by the top tooling at a first stage of a top tooling movement into a cavity of the bottom tooling, wherein the first stage starts when the top tooling at least partially contacts the work-piece and ends at an intermediate position when the top tooling has moved into the bottom tooling from a starting position for a first predetermined distance; and continuing pressing the work-piece and activating the clamping device at a second stage, wherein the second stage starts from the intermediate position and ends after the top tooling has moved a second predetermined distance into the bottom tooling; and wherein a stretch rate of the work-piece due to a clamping force by the clamping device is greater at the second stage than that in the first stage;

wherein the clamping device includes a first part disposed on the top tooling and a second part disposed on the bottom tooling, and the second part does not move during the top tooling movement at the first stage and the second stage.

14. The method of claim 13, wherein the first predetermined distance is approximately 80% of a total moving distance and the second predetermined distance is approximately 20% of the total moving distance.

* * * * *